US010347389B2

(12) United States Patent
Singh

(10) Patent No.: US 10,347,389 B2
(45) Date of Patent: Jul. 9, 2019

(54) SYSTEM AND METHOD FOR MOLECULAR-LIKE HIERARCHICAL SELF_ASSEMBLY OF MONOLAYERS OF MIXTURES OF PARTICLES

(71) Applicant: New Jersey Institute of Technology, Newark, NJ (US)

(72) Inventor: Pushpendra Singh, Pine Brook, NJ (US)

(73) Assignee: New Jersey Institute of Technology, Newark, NJ (US)

( * ) Notice: Subject to any disclaimer, the term of this patent is extended or adjusted under 35 U.S.C. 154(b) by 251 days.

(21) Appl. No.: 14/947,536

(22) Filed: Nov. 20, 2015

(65) Prior Publication Data

US 2016/0148718 A1 May 26, 2016

Related U.S. Application Data

(60) Provisional application No. 62/082,728, filed on Nov. 21, 2014.

(51) Int. Cl.
*H01B 3/00* (2006.01)
*H01B 19/00* (2006.01)

(52) U.S. Cl.
CPC ..... *H01B 3/004* (2013.01); *H01B 3/002* (2013.01); *H01B 19/00* (2013.01)

(58) Field of Classification Search
CPC ... B01L 3/502761; H01B 3/004; H01B 3/002; H01B 19/00; B82Y 40/00; B82Y 30/00
See application file for complete search history.

(56) References Cited

U.S. PATENT DOCUMENTS

2012/0067725 A1* 3/2012 Aubry ..... B82Y 40/00 204/600

OTHER PUBLICATIONS

Nicolson, M.M., The interaction between floating particles, *Proc. Cambridge Philos. Soc.*, 45, pp. 288-295, 1949.
Cox, P. A. Hydrophilous pollination. Ann. Rev. Ecol, Syst., 19, pp. 261-280, 1989.

(Continued)

*Primary Examiner* — Xiuyu Tai
(74) *Attorney, Agent, or Firm* — McCarter & English, LLP

(57) ABSTRACT

This invention relates to a technique that uses an externally applied electric field to self-assemble monolayers of mixtures of particles into molecular-like hierarchical arrangements on fluid-liquid interfaces. The arrangements consist of composite particles which are arranged in a pattern. The structure of a composite particle depends on factors such as the relative sizes of the particles and their polarizabilities, and the electric field intensity. If the particles sizes differ by a factor of two or more, the composite particle has a larger particle at its core and several smaller particles form a ring around it. The number of particles in the ring and the spacing between the composite particles depend on their polarizabilities and the electric field intensity. Approximately same sized particles form chains in which positively and negatively polarized particles alternate, and when their polarizabilities are comparable they form tightly packed crystals.

13 Claims, 15 Drawing Sheets

(56) References Cited

OTHER PUBLICATIONS

Cox, P. A., et al. Two-dimensional pollination in hydrophilous plants: Convergent evolution in the genera *Halodule* (Cymodoceaceae), *Halophila* (Hydrocharitaceae), *Ruppia* (Ruppiaceae), and *Lepilaena* (Zannichelliaceae). Amer. J. Bot. 76(2): pp. 164-175, 1989.
Kralchevsky, P.A., et al., Capillary Meniscus Interaction between Colloidal Particles Attached to a Liquid-Fluid Interface, J. Colloid and Interface Sci., vol. 151, No. 1, pp. 79-94, Jun. 1992.
Lucassen, J., Capillary forces between solid particles in fluid interfaces, Colloids and Surfaces, 65, pp. 131-137, 1992.
Blanco, A., et al., Large-scale synthesis of a silicon photonic crystal with a complete three-dimensional bandgap near 1.5 micrometres, Nature, vol. 405, pp. 437-440, 2000.
Stamou, D., et al., Long-range attraction between colloidal spheres at the air-water interface: The consequence of an irregular meniscus, Phys. Rev. E, vol. 62(4), pp. 5263-5272, 2000.
Gust, D., et al., Mimicking Photosynthetic Solar Energy Transduction, Acc. Chem. Res., 34, pp. 40-48, 2001.
Binks, B.P., Current Opinion in Colloid and Interface Science, 2002, 7, 21-41.
Nikolaides, M.G., et al., Electric-field-induced capillary attraction between like-changed particles at liquid interfaces, Nature vol. 420, pp. 299-301, 2002.
Jiang, P. et al., Wafer-Scale Periodic Nanohole Arrays Templated from Two-Dimensional Nonclose-Packed Colloidal Crystals, J. Am. Chem. Soc., vol. 127, pp. 3710-3711, 2005.
Singh, P., et al., Fluid dynamics of floating particles, *J. Fluid Mech.*, vol. 530, pp. 31-80, 2005.
Tang, Z., et al., Self-Assembly of CdTe Nanocrystals into Free-Floating Sheets, Science, vol. 314, pp. 274-278, 2006.
Bresme, F., et al., Nanoparticles at fluid interfaces, J. Phys. Condens. Matter 19, 413101, pp. 1-33, 2007.
Aubry, N., et al., Micro- and nanoparticles self-assembly for virtually detect-free, adjustable monolayers, Proc. Natl. Acad. Sci. U.S.A. vol. 105(10), pp. 3711-3714, 2008.
Aubry, N., et al., Physics underlying controlled self-assembly of micro- and nanoparticles at a two-fluid interface using an electric field, Phys. Rev. E 77, 056302, pp. 1-11, 2008.
Janjua, M., et al., Electric field induced alignment and self-assembly of rods on fluid-fluid interfaces, Mech. Res. Comm., 36, pp. 55-64, 2009.
Singh, P., et al., Dispersion and attraction of particles floating on fluid-liquid surfaces, *Soft Matter*, 6, pp. 4310-4325, 2010.
Janjua, M., et al., Electric field-induced self-assembly of micro- and nanoparticles of various shapes at two-fluid interfaces, Electrophoresis, 32, pp. 518-526, 2011.
U.S. Appl. No. 62/082,728, filed Nov. 21, 2014.
U.S. Appl. No. 62/781,692, filed Mar. 4, 2014.

* cited by examiner

Initial Final (a) (b)

Initial

Final (a)

graphical representation

- 63 µm glass particles
- 71 µm copolymer particles (a)

graphical representation

- 63 µm glass particles
- 71 µm copolymer particles (b)

(c)

(a)

(b)

(c)

SYSTEM AND METHOD FOR MOLECULAR-LIKE HIERARCHICAL SELF_ASSEMBLY OF MONOLAYERS OF MIXTURES OF PARTICLES

This application claims the benefit of U.S. Provisional Patent Application Ser. No. 62/082,728 filed 21 Nov. 2014.

STATEMENT REGARDING FEDERALLY SPONSORED RESEARCH

This invention was made with U.S. government support under grant and/or contract Award # CBET-1067004, and I-Corps-1522607 through the National Science Foundation. Therefore, the U.S. government has certain rights in the invention.

BACKGROUND OF THE INVENTION

Particles trapped in fluid-liquid interfaces interact with each other via lateral capillary forces that arise because of their weight, and when present also by other forces such as electrostatic forces, to form monolayer arrangements. Particles are able to float at the interface because of the vertical capillary forces that arise due to the deformation of the interface. If the interface did not deform, the vertical capillary forces will be zero and the particles will not be able to float on the surface. But, this also results in lateral capillary forces. A common example of capillarity-driven self-assembly is the clustering of breakfast-cereal flakes floating on the surface of milk. The deformation of the interface by the flakes gives rise to lateral capillary forces which cause them to cluster. In recent years, many studies have been conducted to understand this behavior of trapped particles because of their importance in a range of physical applications and biological processes, e.g., formation of pollen and insect egg rafts, self-assembly of particles at fluid-fluid interfaces resulting in novel nano-structured materials, stabilization of emulsions, and the formation anti-reflection coatings for high-efficiency solar cells, photonic crystals and biosensor arrays. Capillarity-driven self-assembly, however, produces monolayers which have defects and lack long-range order, and for monolayers containing two or more different types of particles the technique does not allow for any control of the particle-scale structure as capillary forces simply cause particles to cluster.

SUMMARY OF THE INVENTION

This invention relates to a technique that uses an externally applied electric field to self-assemble monolayers of mixtures of particles into molecular-like hierarchical arrangements on fluid-liquid interfaces. The arrangements consist of composite particles (analogous to molecules) which are arranged in a pattern. The structure of a composite particle depends on factors such as the relative sizes of the particles and their polarizabilities, and the electric field intensity. If the particles sizes differ by a factor of two or more, the composite particle has a larger particle at its core and several smaller particles form a ring around it. The number of particles in the ring and the spacing between the composite particles depend on their polarizabilities and the electric field intensity. Approximately same sized particles form chains (analogous to polymeric molecules) in which positively and negatively polarized particles alternate, and when their polarizabilities are comparable they form tightly packed crystals.

BRIEF DESCRIPTION OF THE DRAWINGS

So that those having ordinary skill in the art will have a better understanding of how to make and use the disclosed systems and methods, reference is made to the accompanying figures wherein.

DETAILED DESCRIPTION OF INVENTION

Figure 1:
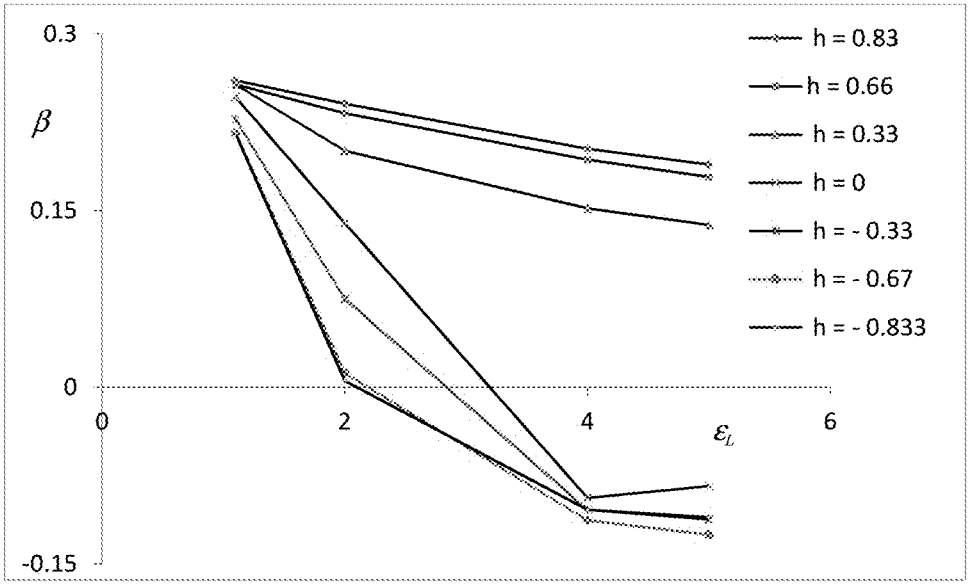
FIG. 1 shows The Clausius-Mossotti factor $\beta$ of a particle at a fluid-liquid interface is plotted as a function of the dielectric constant of the lower liquid ($\varepsilon_L$) for seven different dimensionless vertical positions ($h=h_2/\alpha$) of the particle in the interface; for h=0, the particle center is at the interface. The dielectric constant of the particle is 2.0 and that of the upper liquid is 1.0.

The following is a detailed description of the invention provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

Certain embodiments of the present invention relate to monolayers containing two or more types of particles, with different dielectric properties, that can be self-assembled by applying an electric field in the direction normal to the interface. The monolayers are formed by exploiting the fact that the lateral dipole-dipole force between two particles can be repulsive or attractive depending on their polarizabilities and that the intensity of the force can be varied by selecting suitable upper and lower fluids. The force is repulsive when both particles are positively or negatively polarized, but attractive when one particle is positively polarized and the other is negatively polarized. The force also depends on their sizes and the electric field intensity.

In certain embodiments of the present invention the differences in the particles' polarizabilities and sizes derive a hierarchical self-assembly process analogous to that occurs at atomic scales. Groups of particles first combined to form composite particles (analogous to molecules) and then these composite particles self-assembled in a pattern (like molecules arrange in a material). The force between similar particles was repulsive (because they have the same polarizabilities), and so they moved apart which allowed particles that attracted to come together relatively unhindered to form composite particles. The net force among the particles forming a composite particle was attractive, and so after a composite particle was formed it remained intact while the electric field was kept on. Also, particles form crystalline arrangements for certain fluid particle properties.

It is noteworthy that the energy needed for a particle to desorb from a fluid-liquid interface is several orders of magnitude larger than thermal energy. Therefore, once nano-to-micron sized particles are adsorbed, they remain adsorbed while moving laterally in the interface in response to lateral capillary and dipole-dipole forces. Furthermore, since particles trapped in a fluid-liquid interface are free to move laterally, they self-assemble even when lateral forces driving the assembly are small. The only resistance to their lateral motion is hydrodynamic drag which can slow the motion but cannot stop it. This is obviously not the case for a monolayer assembled on a solid substrate since particles are not free to move laterally because of the presence of adhesion and friction forces. In fact, very-small particles do not self-assemble even on a fluid-liquid interface when lateral capillary forces become smaller than Brownian forces. For example, on an air-water interface, lateral capillary forces in the absence of an electric field become smaller than Brownian forces for particles smaller than about 10 μm and so particles smaller than this limiting size undergo Brownian motion on the interface and do not cluster. However when a sufficiently strong electric field is applied, the electrically-induced lateral forces remain stronger than Brownian forces making self-assembly of nanoparticles possible.

The lateral force $F_l$ between two particles, i and j, adsorbed at a fluid-liquid interface in the presence of an electric field in the direction normal to the interface is given by:

$$F_l = -\frac{w_i w_j}{2\pi\gamma}\frac{1}{r} + \frac{3p_i p_j}{4\pi\varepsilon_o\varepsilon_L}\frac{1}{r^4}. \tag{1}$$

Here $w_j$ is the vertical force acting on the $j^{th}$ particle, $p_j$ is the induced dipole moment of $j^{th}$ particle, $\varepsilon_0$ is the permittivity of free space, $\varepsilon_L$ is the permittivity of the lower liquid, $\gamma$ is the interfacial tension, and r is the distance between the particles. The first term represents the lateral capillary force that arises because of the total vertical force acting on the particles which includes their buoyant weights and the vertical electric forces, and the second term represents the dipole-dipole force between them. The force depends on the inter-particle distance, but it is independent of their positions on the interface.

For certain embodiments of the present invention, the first term was negative which means that it caused the particles to come together. The second term is repulsive when both particles are positively or negatively polarized, and so the force between two particles of the same type is always repulsive. If one particle is positively polarized and the other is negatively, the dipole-diploe force is attractive. For this embodiment, since both terms on the right side of equation (1) are attractive, the particles come together to touch each other.

From equation (1) it is noted that the capillary force varies as 1/r and the dipole-dipole electric force varies as $1/r^4$. Therefore, the former dominates when the distance is large and the latter dominates for smaller distances. Both of these contributions vary with the electric field intensity. A stable equilibrium in which particles are not in contact is possible only when the dipole-dipole force is repulsive and the capillary force is attractive. The dimensionless equilibrium spacing ($r_{eq}$) between the particles can be obtained by setting the total lateral force equal to zero and solving the resulting equation to obtain $$\frac{r_{eq}}{a_i} = \left(\frac{3\gamma p_i p_j}{2\varepsilon_0\varepsilon_L w_i w_j a_i^3}\right)^{\frac{1}{3}}. \tag{2}$$

Here $\alpha_i$ is taken to be the larger of the two radii. The spacing ($r_{eq}$) depends on the electric field intensity and other parameters appearing in the equation. The particles touch each other in equilibrium if $r_{eq}$ is less than the sum of their radii. If $p_i p_j$ is negative, both terms on the right side of equation (1) are negative. Thus, the particles come together to touch each other. In the presence of a strong electric field, the capillary and dipole-dipole forces are stronger than Brownian forces making self-assembly of micron- to nano-sized particles possible.

When particles suspended in a fluid are subjected to a uniform electric field they become polarized and interact electrostatically with each other. The dipole-dipole force on a spherical particle i due to particle j in the point-dipole approximation limit is given by equations 3 and 4

$$F(r,\theta) = -12\pi\varepsilon_o\varepsilon_c\beta_1\beta_2 E_0^2\frac{(a_1 a_2)^3}{r^4}((3\cos^2\theta - 1)e_r + \sin 2\theta e_\theta), \tag{3}$$

where $$e_r = \frac{r_j - r_i}{|r_j - r_i|}$$

is the unit vector along the line joining the centers of the two spheres, $e_\theta$ is a unit vector normal to $e_r$ in the plane containing the electric field direction, θ is the angle between the electric field direction and $e_r$. Here $r=|r_j-r_i|$ is the distance between the particles, $E_0$ is the electric field intensity (or the rms value of the electric field in an ac field), $\varepsilon_0=8.8542\times10^{-12}$ F/m is the permittivity of free space, $\alpha_i$ and $\alpha_j$ are the radii of the particles and $$\beta_i(\omega) = \frac{\varepsilon_{pi} - \varepsilon_c}{\varepsilon_{pi} + 2\varepsilon_c}$$

is the Clausius-Mossotti factor of the $i^{th}$ particle. Here $\varepsilon_{pi}$ and $\varepsilon_c$ are the permittivities of the $i^{th}$ particle and the ambient fluid, respectively. For an ac field, $\beta_i$ is the real part of the complex Clausius-Mossotti factor which also depends on the conductivities of the fluid and particles and the frequency of electric field.

Equation (3) is used to model the dipole-dipole force between particles trapped in a fluid-liquid interface when a uniform electric field is applied normal to the interface. The Clausius-Mossotti factors have been estimated numerically accounting for the fact that the particles in the interface are partially immersed in both upper and lower fluids. For two identical particles trapped in an interface the line joining the centers is tangential to the interface and since the electric field is perpendicular to the interface, θ in equation (3) is π/2. Thus, the force is along the line joining the centers of the particles, and so in the tangential direction to the interface and can be written as $$F\left(r, \frac{\pi}{2}\right) = F_D e_r, \tag{4}$$

where $$F_D = 12\pi\varepsilon_o\varepsilon_L\beta_1\beta_2 E_0^2 \frac{(a_1 a_2)^3}{r^4} = \frac{3p_1 p_2}{4\pi\varepsilon_o\varepsilon_L}\frac{1}{r^4}. \tag{5}$$

The direct numerical simulation data was used to verify the above expression for the dipole-dipole force including its variation with r. Here $\beta_1$ and $\beta_2$ account for the fact that the particles are partially immersed in the upper and lower fluids, $\varepsilon_L$ is the dielectric constant of the lower liquid, and $p_1=4\pi\varepsilon_o\varepsilon_L\alpha_1^3\beta_1 E_0$ and $p_2=4\pi\varepsilon_o\varepsilon_L\alpha_2^3\beta_2 E_0$ are their induced dipole moments (see FIG. 1).

The Clausius-Mossotti (CM) factor $\beta$ of a particle trapped in an interface depends on the dielectric constants of the upper and lower fluids and the particle, as well as on the position of the particle in the interface (see FIG. 1). The point-dipole approximation often used in computations cannot be used in this case. Instead, one needs to carry out direct numerical simulations based on the Maxwell stress tensor to account for the modification of the electric field by the particles and the fluid-liquid interface. The position of the particle in the interface depends on the fluids and particle densities, the interfacial tension, and the three-phase contact angle on the surface of the particle, and so the CM factor is difficult to compute analytically. For the results of FIG. 1, the interface around the particle was assumed to be flat and the particle position in the interface was varied.

The force can be attractive or repulsive depending on the sign of $\beta_1\beta_2$. For $\beta_1\beta_2>0$, the force is repulsive, and for $\beta_1\beta_2<0$ it is attractive. For two particles of the same type, $\beta_1=\beta_2=\beta$, and so $\beta_1\beta_2=\beta^2>0$. Thus, the force between two particles of the same type is repulsive. The force causes particles to move apart or come together while they remain trapped in the interface. Lateral inter-particle forces, even when they are small, can cause particles to cluster or move apart because particles floating on a liquid surface are free to move laterally. The only resistance to their lateral motion is hydrodynamic drag which can slow the motion but cannot stop it. Also, notice that for two particles of different sizes or with different contact angles, or both, the line joining the centers may not be parallel to the interface, and thus the force may not be tangential to the interface. The component parallel to the interface causes the particles to come together or move apart. The component normal to the interface moves them vertically away from their equilibrium positions, but for the range of electric field intensity considered in embodiments of the present invention it was small compared to the vertical capillary force and so particles remained trapped at the interface.

In certain embodiments of the present invention, the sign of $\beta_1\beta_2$ was determined for a particle pair form their tendency to move apart or come closer when an electric field was applied. However, although the lateral dipole-dipole force is proportional to $\beta_1\beta_2$, the particles also experience a lateral capillary force which for the particles was attractive and so in the absence of an electric field they clustered. Therefore, if the particles moved apart when an electric field was applied, $\beta_1\beta_2$ was definitely positive. However, if they did not move apart, either $\beta_1\beta_2$ was negative or the dipole-dipole force was not strong enough to overcome the lateral capillary force. For this embodiment, the velocity with which the two particles approached each other was used to determine the sign of $\beta_1\beta_2$. If the velocity in the presence of electric field was smaller, the dipole-dipole force was repulsive but not large enough to overcome the capillary force. However, if the velocity was larger, the dipole-dipole force was attractive and so $\beta_1\beta_2$ was negative.

The dipole-dipole interaction energy, $w_D$, between two particles can be obtained by integrating equation (5) with respect to r, which gives $$W_D(r) = 4\pi\varepsilon_o\varepsilon_L\beta_1\beta_2 E_0^2 \frac{(a_1 a_2)^3}{r^3}. \tag{6}$$

Assuming that $\varepsilon_L=4.0$, $\beta_1=0.5$, $\beta_2=-0.5$, $E_0=3\times10^6$ V/m, $\alpha_1=\alpha_2=\alpha$ and $r=2\alpha$. For these parameter values, for $\alpha=1$ μm, $w_D(r)=\sim3.13\times10^4$ kT and for $\alpha=100$ nm, $w_D(r)=\sim31.3$ kT, where k is the Boltzmann constant and T is the temperature, indicating that the repulsive dipole-dipole force is larger than the Brownian force. This shows that the dipole-dipole force can be used to manipulate nanoparticles.

The electric field exerts an additional force on floating particles in the direction normal to the interface which alters the magnitude of lateral capillary forces between them. The dependence of the electric force on the parameters such as the dielectric constants of the fluids and particle, and the particle position in the interface has been determined numerically in the literature. The direct numerical simulation data was used to obtain the following expression for the vertical electric force:

$$F_{ev} = a^2\varepsilon_0\varepsilon_a\left(\frac{\varepsilon_L}{\varepsilon_a}-1\right)E_0^2 f_v\left(\frac{\varepsilon_L}{\varepsilon_a}, \frac{\varepsilon_p}{\varepsilon_a}, \theta_c, \frac{h_2}{a}\right). \tag{7}$$

Figure 2:
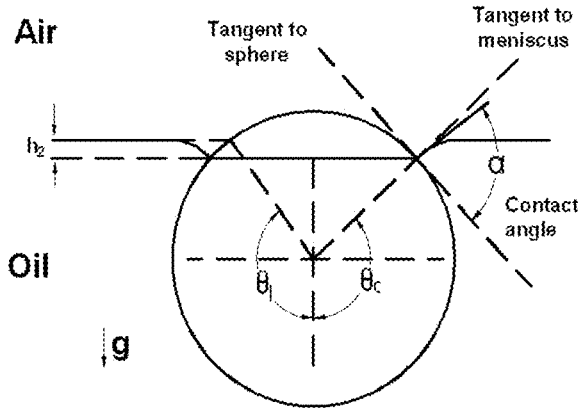
FIG. 2 shows a schematic of a heavier-than-liquid hydrophilic (wetting) sphere of radius $\alpha$ hanging on the contact line at $\theta_c$. The point of extension of the flat meniscus on the sphere determines the angle $\theta_1$ and height $h_2$. The angle $\alpha$ is fixed by the Young-Dupré law and angle $\theta_c$ by the force balance.

Here $\alpha$ is the particle radius, and $\varepsilon_p$, $\varepsilon_a$ and $\varepsilon_L$ are the dielectric constants of the particle, the upper fluid and the lower fluid, respectively, and $$f_v\left(\frac{\varepsilon_L}{\varepsilon_a}, \frac{\varepsilon_p}{\varepsilon_a}, \theta_c, \frac{h_2}{a}\right)$$

is a dimensionless function of the included arguments ($\theta_c$ and $h_2$ being defined in FIG. 2). The electric force in the direction normal to the interface alters the position of the particles in the interface, and this in turn alters the deformation of the interface and the magnitude of lateral capillary forces between the particles.

The deformation of the interface due to the trapped particles gives rise to lateral capillary forces that cause them to cluster. Consider the vertical force balance for the $i^{th}$ spherical particle trapped in the interface between two immiscible fluids. The buoyant weight $F_{bi}$ of the particle is balanced by the capillary force $F_{ci}$ and the vertical electric force $F_{evi}$, $$F_{ci}+F_{evi}+F_{bi}=0. \tag{8}$$

The buoyant weight can be written as $$F_{bi} = -g\rho_L a_i^3 f_{bi}\left(\frac{\rho_a}{\rho_L}, \frac{\rho_{pi}}{\rho_L}, \theta_{ci}, \frac{h_{2i}}{a_i}\right),$$

where g is the acceleration due to gravity, $\rho_{pi}$ is the density of the $i^{th}$ particle, $\rho_\alpha$ and $\rho_L$ are the densities of the upper and lower fluids, $\theta_{ci}$ and $h_{2i}$ define the floating position for the $i^{th}$ particle (see FIG. 2), and $f_{pi}$ is the dimensionless buoyant weight which is a function of the included arguments. Also, it is easy to deduce from FIG. 2 that the capillary force $F_{ci}$ can be written as $F_{ci}=-2\pi\gamma\alpha_i \sin\theta_{ci} \sin(\theta_{ci}+\alpha_i)$, where $\alpha_i$ is the three-phase contact angle on the surface of the $i^{th}$ particle and $\gamma$ is the interfacial tension. Using these expressions in equation (8), we obtain $$\begin{aligned} F_{ci} &= -2\pi\gamma a_i \sin\theta_{ci}\sin(\theta_{ci}+\alpha_i) \\ &= -(F_{evi}+F_{bi}) \\ &= g\rho_L a_i^3 f_{bi}\left(\frac{\rho_a}{\rho_L}, \frac{\rho_{pi}}{\rho_L}, \theta_{ci}, \frac{h_{2i}}{a_i}\right) - \\ &\quad a_i^2\varepsilon_0\varepsilon_a\left(\frac{\varepsilon_L}{\varepsilon_a}-1\right)E_0^2 f_{vi}\left(\frac{\varepsilon_a}{\varepsilon_L}, \frac{\varepsilon_{pi}}{\varepsilon_L}, \theta_{ci}, \frac{h_{2i}}{a_i}\right) \end{aligned} \tag{9}$$

The above equation takes the following dimensionless form $$\begin{aligned} &2\pi\sin\theta_{ci}\sin(\theta_{ci}+\alpha_i) = \\ &\quad -B_i f_{bi}\left(\frac{\rho_a}{\rho_L}, \frac{\rho_{pi}}{\rho_L}, \theta_{ci}, \frac{h_{2i}}{a_i}\right) + W_{Ei}\left(\frac{\varepsilon_L}{\varepsilon_a}-1\right) f_{vi}\left(\frac{\varepsilon_a}{\varepsilon_L}, \frac{\varepsilon_{pi}}{\varepsilon_L}, \theta_{ci}, \frac{h_{2i}}{a_i}\right). \end{aligned} \tag{10}$$

Here $\beta_i=\rho_L\alpha_i^2 g/\gamma$ is the Bond number and $$W_{Ei} = \varepsilon_0\varepsilon_a \frac{a_i E_0^2}{\gamma}$$

is the electric Weber number for the $i^{th}$ particle.

The external vertical force acting on a particle in equilibrium is balanced by the vertical component of the capillary force that arises because of the deformation of the interface. The profile of the deformed interface around a particle can be obtained by integrating Laplace's equation and using the boundary conditions that the interface far away from the particle is flat and that the angle between the interface and the horizontal at the particle surface is known in terms of the total external force acting on the particle. It can be shown that the interface height $\eta_i$ (r) at a distance r from particle i is given by $$\eta_i(r)=\alpha_i \sin(\theta_{ci})\sin(\theta_{ci}+\alpha_i)K_0(qr) \tag{11}$$

where $K_0(qr)$ is the modified Bessel function of zeroth order and $$q = \sqrt{\frac{(\rho_L-\rho_a)g}{\gamma}}.$$

In obtaining above expression we have ignored the influence of the electrostatic stress on the interface, and assumed that the interfacial deformation is small.

Consider a second particle j at a distance r from the first particle. The height of the second particle is lowered because of the interfacial deformation caused by the first particle, and thus the work done by the electrostatic force and gravity (buoyant weight) on particle j is $$W_c=-\eta_i(r)w_j, \tag{12}$$

where $w_j=F_{evi}+F_{bj}$ is the vertical force acting on the $j^{th}$ particle. Notice that the works done by the electric force and gravity have been treated in a similar manner because both of these force fields are external to the fluid-particle system. The analysis does not account for the multi-body electrostatic interactions among floating particles and so, strictly speaking, our results are applicable only when the particle concentration is small.

Using equations (10) and (11), in equation (12) is obtained $$\begin{aligned} W_c &= -\frac{w_i w_j}{2\pi\gamma}K_0(qr) \\ &= -\left\{-\varepsilon_0\varepsilon_a\left(\frac{\varepsilon_L}{\varepsilon_a}-1\right)a_i^2E_0^2 f_{vi} + \frac{4}{3}\pi a_i^3\rho_{pi}g f_{bi}\right\} \\ &\quad \left\{-\varepsilon_0\varepsilon_a\left(\frac{\varepsilon_L}{\varepsilon_a}-1\right)a_j^2E_0^2 f_{vj} + \frac{4}{3}\pi a_j^3\rho_{pj}g f_{bj}\right\}\frac{1}{2\pi\gamma}K_0(qr) \end{aligned} \tag{13}$$

Figure 3:
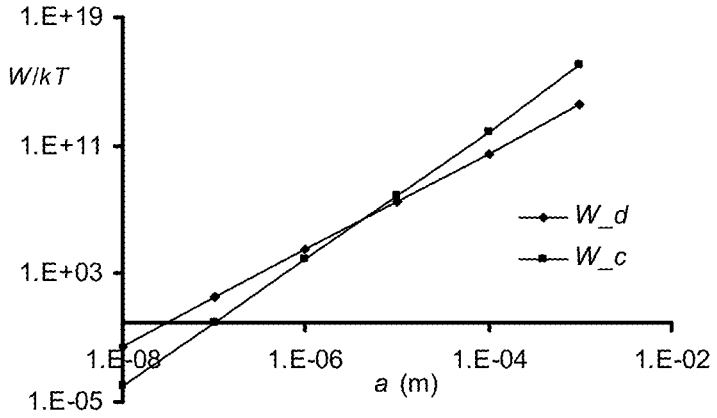
FIG. 3 shows the dipole-dipole repulsion energy ($W_d$) and the capillary attraction energy ($W_c$) divided by kT are plotted against the particle radius. The parameters are: $\varepsilon_a=2.0$, $\varepsilon_L=4.0$, $\beta_1=0.5$, $\beta_2=-0.5$, $E_0=3\times10^6$ V/m, $f_v=1$, $f_D=1$, $\gamma=0.01$, $\rho_{\alpha=1}$ kg/m$^3$, $\rho_L=1000$ kg/m$^3$, $\rho_p=3000$ kg/m$^3$, $\alpha_1=\alpha_2=\alpha$ and $r=2\alpha$. Since W/(kT)>1 for particles larger than approximately 100 nm, the capillary attraction and the dipole-dipole repulsion are stronger than the Brownian force.

In FIG. 3, the interaction energy $W_c$ is plotted as a function of the particle radius. The parameter values are: $\varepsilon_a=2.0$, $\varepsilon_L=4.0$, $E_0=3\times10^6$ V/m, $f_v=1$, $\gamma=0.01$, $\rho_\alpha=1$ kg/m$^3$, $\rho_L=1000$ kg/m$^3$, $\rho_p=3000$ kg/m$^3$, $\alpha_1=\alpha_2=\alpha$ and $r=2\alpha$. The figure shows that for these parameter values, the interaction energy (13) is significant for nano sized particles. The capillary force can cause particles to cluster only when the interaction energy is greater than kT. When the net external vertical force acting on the particles is small in the sense that the associated interaction energy is smaller than kT they do not cluster as their motion is dominated by thermal fluctuations. Also notice that the interaction energy is positive when the sign of one of the factors in the curly brackets is negative and of the other positive. In this case, the capillary force between the particles is repulsive.

The lateral capillary force between particles i and j is given by $$F_{lc} = -\frac{dW_c}{dr} = -\frac{w_i w_j}{2\pi\gamma}qK_1(qr) \tag{14}$$

where $K_1(qr)$ is the modified Bessel function of first order. For two particles far away from each other, the above reduces to $$\begin{aligned} F_{lc} &= -\frac{w_i w_j}{2\pi\gamma}\frac{1}{r} \\ &= -\left(-\varepsilon_0\varepsilon_a\left(\frac{\varepsilon_L}{\varepsilon_a}-1\right)a_i^2E_0^2 f_{vi} + \frac{4}{3}\pi a_i^3\rho_{pi}g f_{bi}\right) \\ &\quad \left(-\varepsilon_0\varepsilon_a\left(\frac{\varepsilon_L}{\varepsilon_a}-1\right)a_j^2E_0^2 f_{vj} + \frac{4}{3}\pi a_j^3\rho_{pj}g f_{bj}\right)\frac{1}{2\pi\gamma r} \end{aligned} \tag{15}$$

The lateral capillary force depends on the products of the net external vertical forces acting on the particles, which include their buoyant weights and vertical electric forces. When the buoyant weight of the particles is negligible the force varies as the fourth power of the electric field intensity and the product of the second powers of their radii ($\alpha_1^2\alpha_2^2$). The electric field enhances the lateral capillary force when the electric force and the buoyant weight are in the same direction, otherwise it diminishes it.

Furthermore, if the vertical electric force on a particle is not in the same direction as the buoyant weight, there is a critical electric field intensity for which the net vertical force acting on the particle becomes zero. For this critical field intensity, the lateral capillary force between the particle and any other particle is zero, even when the latter particle deforms the interface and the latter type of particles cluster. The electric field, therefore, can be used to selectively decrease, and even eliminate, the capillarity induced attraction of the particles for which the vertical electric force is in the opposite direction of the buoyant weight.

The total lateral force $F_l$ between two particles is the sum of the dipole-diploe force (5) and the lateral capillary force (15)

$$F_l = F_{lc} + F_D = -\frac{w_i w_j}{2\pi\gamma}\frac{1}{r} + \frac{3p_1 p_2}{4\pi\varepsilon_0\varepsilon_L}\frac{1}{r^4} \tag{16}$$

The relative magnitudes of the lateral capillary force and the dipole-dipole force, and their signs determine the equilibrium spacing between the particles. Both of these forces vary with the electric field intensity and the distance. The capillary force varies inversely with the distance, and the dipole-dipole electric force inversely with the fourth power of the distance. Therefore, the former dominates when the distance is large and the latter dominates for smaller distances.

The dimensionless equilibrium spacing between two particles can be obtained by setting the total lateral force in equation (16) to zero, and solving it for $r=r_{eq}$. If both terms are negative (attractive), the particles come together. If the second term is repulsive, the particles move away from each other to a distance where the two forces become equal. A stable non-zero spacing, which is possible only when the dipole-dipole force is repulsive and the capillary force is attractive, is given by $$\frac{r_{eq}}{a_i} = \left(\frac{3\gamma p_i p_j}{2\varepsilon_0\varepsilon_L w_i w_j a_i^3}\right)^{\frac{1}{3}} = \left(\frac{24\pi^2\varepsilon_0\varepsilon_L\gamma\beta_i\beta_j a_j E_0^2}{a_i^2\left(-\varepsilon_0\varepsilon_a\left(\frac{\varepsilon_L}{\varepsilon_a}-1\right)E_0^2 f_{vi} + \frac{4}{3}\pi a_i\rho_{pi} g f_{bi}\right)\left(-\varepsilon_0\varepsilon_a\left(\frac{\varepsilon_L}{\varepsilon_a}-1\right)E_0^2 f_{vj} + \frac{4}{3}\pi a_j\rho_{pj} g f_{bj}\right)}\right)^{\frac{1}{3}} \tag{17}$$

This expression gives the dependence of the dimensionless equilibrium spacing on the electric field intensity and other parameters of the problem. Here $r_{eq}$ has been nondimensionalized by $\alpha_i$ which is taken to be the radius of the larger of the two particles. The particles touch each other in equilibrium if $r_{eq}$ is less than the sum of their radii. Since the capillary and dipole-dipole forces both vary with the electric field intensity, the equilibrium spacing can be varied by adjusting the field intensity. The dimensionless parameters $f_{vi}$, $\beta_i$ and $f_{bi}$, i=1, 2, themselves depend on several parameters. Also note that the above analysis is for two isolated particles and so not directly applicable to a monolayer where the concentration of particles is not small. It however provides an estimate of the forces that are important in determining the microstructure of a monolayer.

For a mixture containing two different types of particles, say "1" and "2", there are three different pairs of lateral dipole-dipole and capillary forces whose relative strengths and directions determine the particle scale arrangement for the mixture. The three pairs of forces are those between: (i) particles of type 1; (ii) particles of type 2; and (iii) particles of types 1 and 2. The lateral capillary force between two particles of the same type is attractive, but the force between the particles of different types can be attractive or repulsive. The latter is the case when one is hydrophobic and the other is hydrophilic. For all of the particle pairs considered in the present invention the lateral capillary force was attractive. The magnitudes of capillary forces for the different particle pairs were however different.

The three pairs of dipole-dipole forces are proportional to: (i) $\beta_1^2\alpha_1^6$; (ii)$\beta_2^2\alpha_2^6$; and (iii) $\beta_1\beta_2(\alpha_1\alpha_2)^3$. The first two of these are between two particles of the same types, and so are repulsive. The third is between particles of different types which can be attractive or repulsive. For $\beta_1\beta_2>0$ the dipole-dipole force between the particles of types 1 and 2 is repulsive, and so this case is similar to that of one type of particles, except that the magnitudes of the three pairs of forces would be, in general, different. Furthermore, the dipole-dipole forces vary with the particle size. Consequently, the monolayers will have three different lattice distances corresponding to the three pairs of inter-particle forces. The above analyses can be easily extended for the cases in which three or more types of particles are present.

The focus of embodiments of the present invention is on monolayers containing two types of particles for which $\beta_1\beta_2<0$. This case is interesting because the dipole-dipole forces cause particles of the same types to move apart, but those of types 1 and 2 come together. The relative strengths of these forces, which determine their particle scale arrangement, depend on the particles sizes, the electric field intensity, and their intensities of polarizations. The latter can be varied by selecting upper and lower liquids with suitable dielectric properties.

Monolayers were formed by sprinkling mixtures of particles onto the surface of a liquid contained in a chamber or were suspended in the liquids in which they sedimented or rose to the liquid-liquid interface. The chamber was then covered with a transparent upper electrode and the electric field was applied. The focus of this present invention is on binary mixtures for which the dipole-dipole forces between the particles of different types were attractive. Therefore, for most of the cases considered in the present invention, the liquids and the particle mixtures were selected so that one type of particles were positively polarized and the second type were negatively polarized. For example, copolymer particles were negatively polarized on corn oil and on a mixture of castor and corn oils. Glass particles and cubical salt crystals were polarized positively on both of these liquid surfaces. Therefore, the dipole-dipole forces among glass and copolymer particles were attractive, as the former were positively polarized and the latter negatively. The dipole-dipole forces among copolymer particles and salt crystals were also attractive.

The dielectric mismatch is another important parameter. Glass particles, and also salt crystals, adsorbed on corn oil surface repelled each other strongly because they were intensely polarized. Copolymer particles repelled relatively weakly on these liquids as they were weakly polarized. Furthermore, their repulsion on the surface of corn oil was weaker than on the surface of the oil mixture as the dielectric mismatch on the corn oil surface was smaller, making their intensity of negative polarization weaker. The strengths of dipole-dipole and capillary forces also depended on the particles sizes and the electric field intensity.

As discussed herein, a monolayer of particles on an air-liquid interface was formed by sprinkling the mixture onto the liquid surface, and then the chamber was covered with a transparent upper electrode and the electric field was applied to derive the self-assembly process. For forming a monolayer on a liquid-liquid interface, the mixture was suspended in the upper (or the lower) liquid through which it sedimented (or rose) to the interface and the electric field was applied after the mixture was adsorbed at the interface. Monolayers of mixtures of spherical particles, and of spherical and non-spherical particles were considered. Spherical particles used were copolymer and glass particles, and non-spherical particles were cubical salt crystals. The air-liquid interfaces considered were corn oil, a mixture of castor and corn oils, Silicone oil, and the liquid-liquid interface considered contained corn oil as the upper liquid and Silicone oil as the lower liquid.

For certain embodiments of the present invention, glass particles and salt crystals were positively polarized which was ensured by selecting the lower and upper fluids with dielectric constants smaller than that of the particles. Although these particles were positively polarized, their intensities of polarizations were different in the fluid-liquid interfaces considered. Copolymer particles were negatively polarized for all of the cases considered, and their intensity of polarizations were also different in the fluid-liquid interfaces considered. Their sense of polarization in an air-liquid interface, however, could not be determined from the dielectric constant values alone because they were partly immersed in the air and partly in the lower fluid, and their dielectric constant was smaller than that of the lower liquids, but was larger than that of air. To determine their sense of polarization, experiments were conducted in which the approach velocity of a copolymer particle and a positively polarized particle was measured as a function of the electric field intensity. It was found that the velocity increased with increasing field intensity, and hence the dipole-dipole force between the copolymer particle and the positively polarized particle was attractive, and so the former was negatively polarized.

The dipole-dipole force between two particles depends on the product of their intensities of polarizations and so the polarizabilities of both particles are important. The force between identical particles, which varies as the square of their intensity of polarization, can be very small for weakly polarized particles. If one particle is intensely polarized and the other is weakly polarized, the force can be moderately strong. For the fluid-liquid interfaces considered, the intensity of polarization of copolymer particles in increasing order was on: corn oil, the mixture of corn and castor oils, Silicone oil, and corn oil-Silicone oil interface. Consequently, the repulsion between copolymer particles was the weakest on a corn oil surface and the strongest in the interface between corn oil and Silicone oil. On the mixture corn and castor oils, the repulsion was weak, but stronger than on corn oil. The repulsion on the surface of Silicone oil was stronger than on the oil mixture. The intensity of polarization of positively polarized glass particles in decreasing order was on: corn oil, the mixture of corn and castor oils, Silicone oil, and corn oil-Silicone oil interface. Thus, the dipole-dipole repulsion between two glass particles was the strongest on corn oil and the weakest in the interface between corn oil and Silicone oil.

Figure 4:
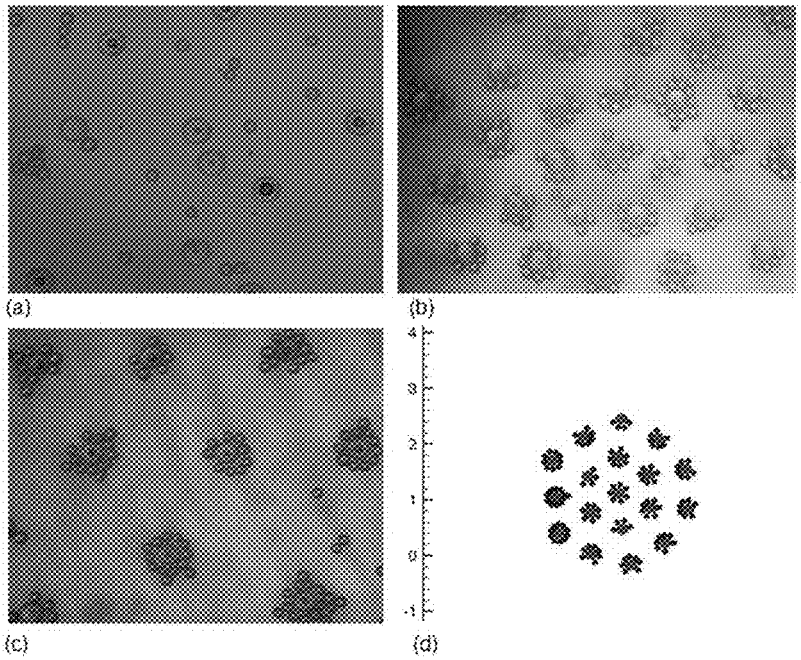
FIG. 4 shows monolayers of mixtures of 71 μm copolymer and 150 μm glass particles on the surface of corn oil. The magnification is 50×. (a) Initial distribution. (b) After a voltage of 5000 V was applied, the mixture self-assembled to form composite particles which were arranged on a triangular lattice. The gap between the electrodes was 10 mm, and so the applied electric field intensity was 500 kV/m. A composite particle consisted of a glass particle at the center which was surrounded by a ring of copolymer particles. The distance between the composite particles was 6.6a, where a is the diameter of glass particles. (c) The distance between the composite particles increased when the voltage was increased to 10000 V, but this did not alter the structure of composite particles. (d) Numerical simulation of self-assembly of mixtures of particles on liquid surfaces. The parameters were selected to match 71 μm copolymer and 150 μm glass particles on corn oil. The electric field intensity was 500 kV/m. The ratio of the number of small to larger particles was 7:1. The distance between the composite particles was 7.4$\alpha$which was approximately 12% larger than the experimental distance in (b) for the same electric field intensity. Since the concentration of smaller particles was initially larger near the left and lower sides, the particle rings in these regions contain more particles.

In addition to the electric field intensity and the intensities of polarizations of the particles, the hierarchical arrangement of a monolayer depended on the diameters of the particles. The arrangement for a mixture of ~71 μm copolymer and ~150 μm glass particles on the surface of corn oil is shown in FIG. 4, and on the surface of the oil mixture in FIG. 5*a*. On both liquids, copolymer particles formed rings around glass particles to form composite particles. The electric field caused intensely polarized glass particles to move several diameters apart from each other to arrange on a triangular lattice implying that the repulsive dipole-dipole forces among them were the strongest. The number of copolymer particles in the ring of a glass particle depended on the local concentration of copolymer particles, and since the local concentrations of the two types of particles in the mixture was not uniform, the number of particles in the rings varied. The particles of a ring touched each other since the repulsion between copolymer particles was weaker than their attraction towards the glass particle, but this tendency was slightly weaker on the surface of the oil mixture.

Figure 5:
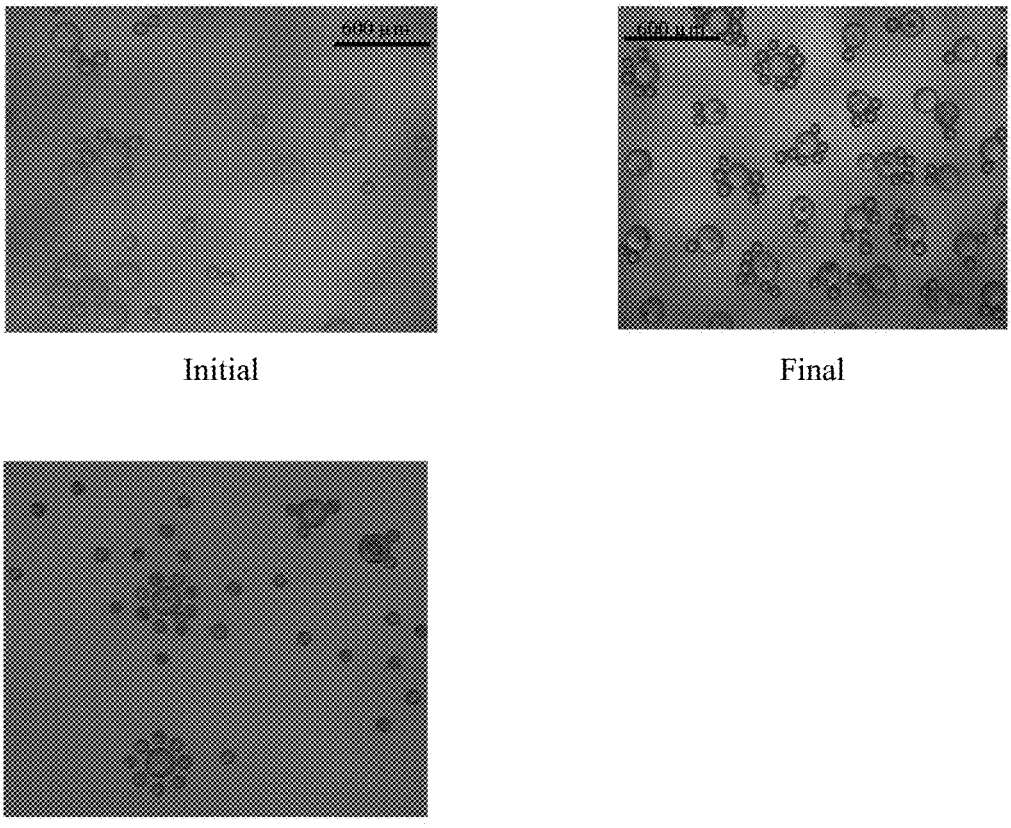
FIG. 5 shows monolayers of mixtures of 71 μm copolymer and 150 μm glass particles. The magnification is 50×. (a) On the surface of the mixture of corn and castor oils. The applied electric field was 5000 V. (b) On the surface of a Silicone oil. The applied electric field was 5300 V.

On the surface of Silicone oil, the repulsive forces between the copolymer particles of a ring were stronger and so in the presence of a strong electric field they did not touch each other (see FIG. 5*b*). If a ring contained more than six particles, the copolymer particles of the ring moved away from the glass particle at the center increasing the ring diameter so that the additional copolymer particles could be accommodated in the ring without touching each other. In the rings with fewer particles, there was sufficient space between the particles and so they remained in contact with the glass particle at the center. The structure of composite particles in FIG. 5*b* is thus similar to that in FIG. 6 where the smaller sized particles were more intensely polarized.

For the case described in FIG. 4, the larger sized particles (150 μm glass spheres) were polarized more intensely than the smaller particles (71 μm copolymer particles). For a mixture of ~71 μm copolymer and ~20 μm glass particles described in FIG. 6, on the other hand, the smaller particles were polarized more intensely than the larger ones. Thus, in the latter case, although glass particles were about three times smaller than copolymer particles, they repelled each other relatively more strongly and formed a triangular lattice in which copolymer particles were imbedded. This was also the case on the surface of the oil mixture (see FIG. 7). On both of these liquid surfaces, some glass particles remained agglomerated because of their small size. If needed, particles can be deagglomerated using a suitable deagglomeration method. Also, since copolymer particles were negatively polarized and were of larger size, they attracted the nearby (positively polarized) glass particles to form composite particles. The distance between glass particles of the lattice increased continuously with increasing electric field intensity, but this increase in the lattice spacing was not accompanied a decrease in the number of glass particles in the ring of a composite particle, except when the intensity was increased above a critical value at which a glass particle was expelled from the ring because of the increased repulsive electric forces between them. The expelled particles were absorbed in the lattice which expanded to accommodate them (see FIG. 6).

Figure 6:
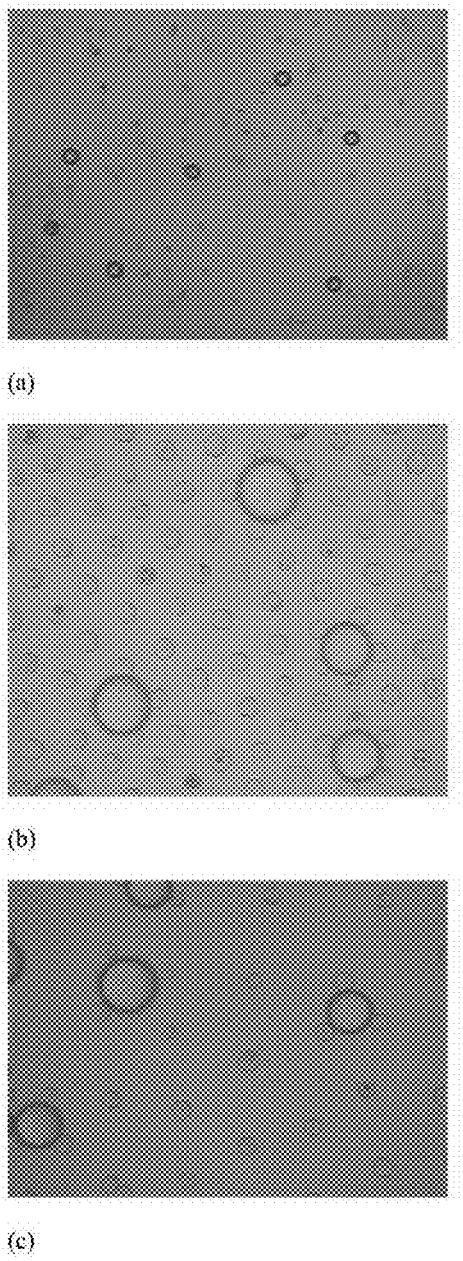
FIG. 6 shows monolayers of mixtures of 20 μm glass and 71 μm copolymer particles on the surface of corn oil. The magnification for the first photograph is 50× and for the later photographs 200×. The applied voltage in (b) was 5300 V and in (c) was 7100 V. Glass particles were arranged on a triangular lattice and copolymer particles were embedded in this lattice. The latter attracted nearby glass particles to form composite particles. The lattice spacing increased with increasing electric field intensity, but the number of particles in the ring of a composite particle remained constant only for a range of intensity. When the field was increased above this range the number decreased by one as a particle was expelled from the ring. The expelled particle became a part of the lattice of glass particles.
Figure 7:
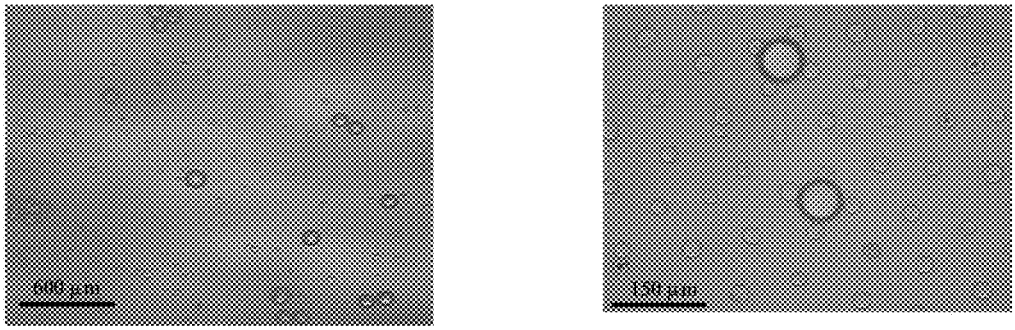
FIG. 7 shows monolayers of mixtures of 20 μm glass and 71 μm copolymer particles formed on the surface of a 30% castor oil and 70% corn oil mixture. The magnification for the first photograph is 50× and for the second 200×. The applied electric field was 5300 V.

The repulsive dipole-dipole forces between the glass particles in the rings of FIGS. 6 and 7 were strong and so they did not touch each other (unless they were agglomerated) which limited their number in the rings. This and the fact that an increase in the electric field intensity above a critical value caused a particle to escape from the ring to the lattice implies that the intra-composite particle forces holding the composite particles together were weaker than those in FIGS. 4 and 5*a*. For the cases shown in the latter figures, the particles of the rings were held tightly by the glass particles at the center and so they could not escape when the electric field intensity was increased. In FIG. 5*b*, the intra-particle forces were in the intermediate range. The repulsive forces between the particles of a ring caused them to move away from each other, but were small compared to the attractive forces with the glass particle at the center, and so they remained close to it when the electric field was increased.

Figure 8:
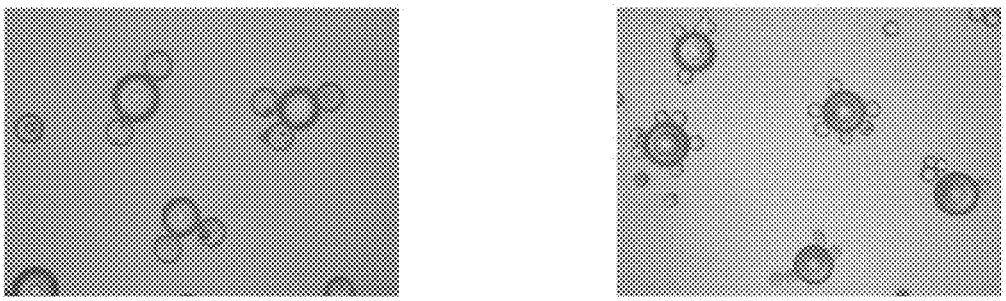
FIG. 8 shows monolayer of particles on the surface of Silicone oil. The applied electric field was 5300 V. The magnification is 200×. (a) Mixture of 71 μm copolymer and 45 μm glass particles. (b) Mixture of 71 μm copolymer and 20 μm glass particles.

In FIG. 8, on the other hand, negatively polarized copolymer particles (larger in size) were more intensely than positively polarized glass particles as the dielectric constant of Silicone oil was relatively larger. This was the case for both 71 μm copolymer and 45 μm glass particles in FIG. 8*a* and 71 μm copolymer and 20 μm glass particles in FIG. 8*b*. Therefore, copolymer particles arranged on a triangular lattice and glass particles formed rings around the copolymer particles. The glass particles of the rings did not touch because of the dipole-dipole repulsion between them. The structure here is therefore similar to that in FIGS. 4 and 5*a* where the larger sized particles were arranged on a triangular lattice, except that the particles of the rings did not touch.

Figure 9:
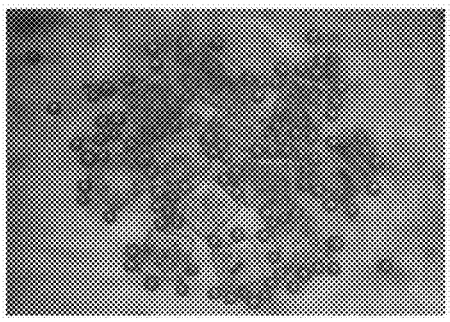
FIG. 9 shows monolayers of mixtures of 63 μm glass and 71 μm copolymer particles on the surface of a 30% castor oil and 70% corn oil mixture. The applied voltage was 5000 V. The magnification is 50×. For clarity, a graphical representation of the final monolayer, showing glass and copolymer particles in different colors, is also included. Particle mixtures self-assembled under the action electric field induced lateral forces into an arrangement consisting of chains in which copolymer and glass particles alternated. The number of particles in the chains varied. Notice that some copolymer particles remained agglomerated.
Figure 9:
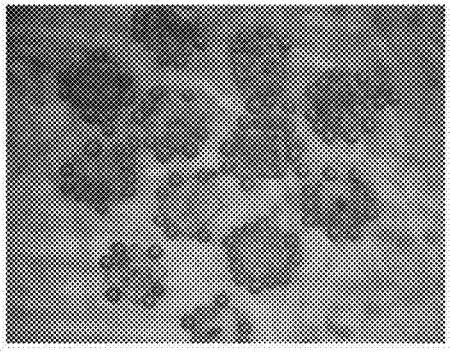
Figure 10:
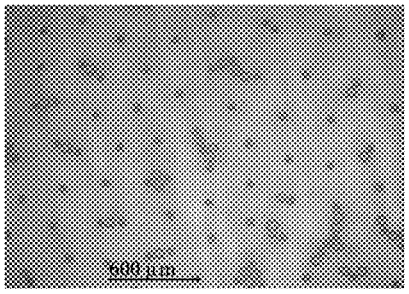
FIG. 10 shows monolayers of mixtures of 63 μm glass and 71 μm copolymer particles. The magnification is 50×. The graphical representations of the final monolayers showing glass and copolymer particles in different colors are also included. (a) The final distribution of particles on the surface of corn oil. (b) The final distribution of particles on the surface of Silicone oil. (c) The final distribution of particles on in the interface between corn oil and Silicone oil.
Figure 10:
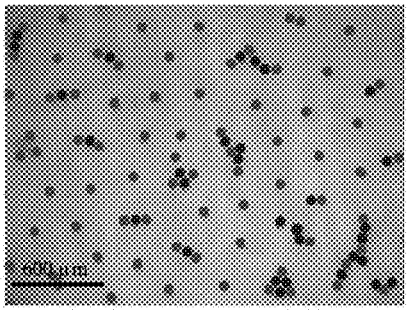
Figure 10:
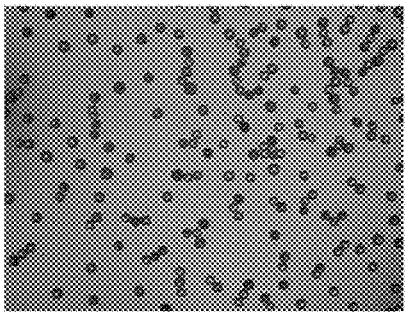
Figure 10:
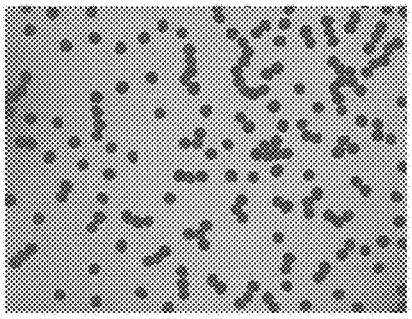
Figure 10:
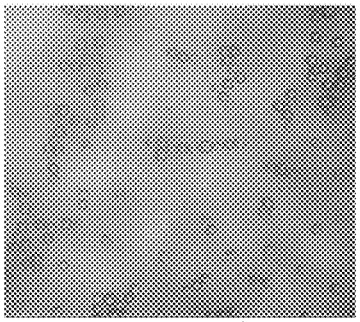

This was observed on corn oil, the mixture of corn and castor oils, Silicone oil, and in the interface between corn and Silicone oils (see FIGS. 9 and 10). On corn oil, the dipole-dipole repulsive forces between glass particles were the strongest, and between copolymer particles the weakest. The attractive dipole-dipole forces between glass and copolymer particles were moderately strong. Therefore, glass particles arranged in a triangular lattice, and attracted neighboring polymer particles to form chains. Short particle chains formed immediately after the electric field was applied and then some of these nearby chains merged to form longer chains. The simplest chains contained two particles, one glass particle and one copolymer particle. The next simplest chain contained a copolymer particle in the middle and two glass particles on the diagonally opposite sides. The repulsion between the glass particles made three-particle chains approximately linear. Longer chains which formed by the merger of shorter chains were not linear and contained branches and some contained agglomerates of two or more copolymer particles. These negatively polarized copolymer agglomerates attracted nearby glass particles and shorter chains more strongly because of their larger size, serving as the anchors for the formation of longer chains in which glass and copolymer particles alternated.

The tendency to form chains was enhanced on the mixture of castor and corn oils (see FIG. 9); the chains were relatively well organized and longer. This was a result of the fact that the dielectric constant of the mixture of castor and corn oils was larger, and so the negative polarization of copolymer particles was enhanced and the positive polarization of glass particles was reduced. This reduced the repulsive dipole-dipole force between glass particles, but increased the attractive force between copolymer and glass particles, making the magnitudes of repulsive and attractive forces more comparable.

The monolayer arrangement on Silicone oil was qualitatively similar. Particles formed chains in which copolymer and glass particles alternated. However, since the dipole-dipole repulsive force between copolymer particles and between glass particles were comparable, fewer copolymer particles remained agglomerated in the presence of a strong electric field. On corn oil, on the other hand, more copolymer particles remained agglomerated. The arrangement in the interface between corn oil and Silicone oil was qualitatively similar. These results show that when the sizes of positively and negatively polarized particles are comparable the preferred arrangement for them is to arrange in chains.

To study the roles of these parameters in the hierarchical self-assembly process for one embodiment of the present invention, mixtures of glass particles of three different sizes and copolymer particles whose size was held fixed were considered. In this embodiment, a mixture of ~71 μm copolymer and ~150 μm glass particles on the surface of corn oil self-assembled when an electric field was applied (see FIG. 4). Glass particles moved several diameters apart to arrange on a triangular lattice, as the repulsive dipole-dipole forces amongst them were the strongest because of their larger size and also because they were intensely polarized (see equation (2)). The spacing among copolymer particles increased only marginally and some remained agglomerated because the dipole-dipole forces for them were relatively weaker. The dipole-dipole force between copolymer and glass particles was attractive, and so several copolymer particles became attached to each of the glass particles to form composite particles (see FIG. 4). A composite particle consisting of a glass particle at the center and surrounded by a ring of copolymer particles was stable in the sense that it remained intact while the electric field was kept on. The number of particles in the ring of a glass particle depended on the number of copolymer particles that were present near it. (There was an area of influence for the glass particle from which it attracted copolymer particles. When there were more copolymer particles present in the area of influence of a glass particle its ring contained more copolymer particles, and vice versa. Therefore, for ensuring that the composition of the assembled composite particles is uniform, the mixtures must be mixed uniformly.) Also, since the repulsion among copolymer particles was relatively weaker than their attraction towards more intensely polarized glass particles, the copolymer particles of a ring touched each other and some copolymer particles joined in later to make the ring of particles two layers thick. The spacing between the composite particles increased with increasing electric field intensity, while the spacing between the copolymer particles of a ring remained unchanged since they were tightly held by the glass particle (see FIGS. 4*b* and 4*c*). There is good agreement between these experimental results and the numerical simulation results shown in FIG. 4*d* for which the parameter values and the particles sizes were selected to match the experimental values.

Figure 11:
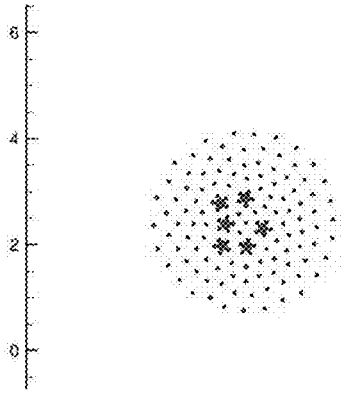
FIG. 11 shows numerical simulation of self-assembly of mixtures of particles on liquid surfaces. The parameters have been selected to match 71 μm copolymer and 20 μm glass particles on corn oil. The applied electric field was 530 kV/m in (a), 700 kV/m in (b), and 900 kV/m in (c). The number of small to larger particles is 15:1. The scale is for reference to show how the monolayer expands or shrinks with the electric field intensity. Notice that the number of particles in the rings of composite particles decreased from 5 to 3 with increasing electric field intensity. The inter-particle spacing for the smaller particles increased with increasing electric field intensity, but the composition of composite particles changed only when the electric field intensity was increased above the threshold values. These results are in agreement with the experimental results shown in FIG. 2.
Figure 11:
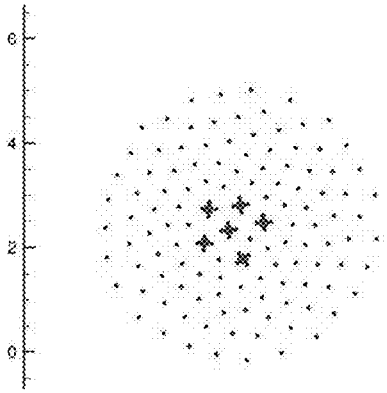
Figure 11:
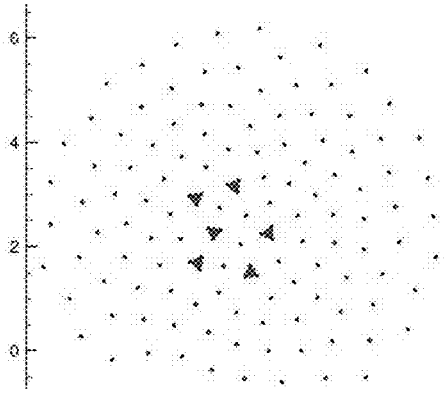

The arrangement for a mixture of ~71 μm copolymer and ~20 μm glass particles on the surface of corn oil was qualitatively similar. It consisted of composite particles in which the larger sized copolymer particles were at the center, and a ring of glass particles surrounded them. However, although glass particles were smaller in size, they arranged on a triangular lattice as they were more intensely polarized than copolymer particles. The positions of copolymer particles which became embedded in the lattice of glass particles depended on their initial positions. Since they were negatively polarized and of larger size, they attracted the nearby glass particles to form composite particles locally distorting the lattice of glass particles. The glass particles of a ring did not touch each other because of the strong dipole-dipole repulsion between them which limited their number in a ring to six or less (see FIG. 6*a*). Furthermore, although the distance between the glass particles forming the lattice increased with increasing electric field intensity, there was a range of intensity for which the number of glass particles in the ring of a composite particle did not change. But, when the intensity was increased beyond this range, one of the glass particles was pushed out of the ring because of the increased repulsive forces between them, and then this number was maintained for a range of electric field intensity. The glass particle pushed out of the ring occupied a position in the lattice of glass particles which reorganized to accommodate the additional particle. This shows that the intra-composite particle forces here were relatively weaker. These results are in agreement with the numerical simulation results reported in FIG. 11 for the same parameter values.

For the case described in FIG. 4, on the other hand, the intra-composite particle forces were stronger, i.e., the copolymer particles of a ring were tightly held by the glass particle at the center, and so when the electric field intensity was increased although the distance between composite particles increased, the microstructures of composite particles did not change. The attractive forces between the glass and copolymer particles were much stronger than the repulsive forces between the copolymer particles. It is noteworthy that for a given mixture of particles the intra-composite particle forces and the number of particles in the rings (analogous to the number of atoms in a molecule), as well as the spacing between the composite particles can be varied by selecting suitable upper and lower fluids and the electric field intensity. For example, the microstructure in FIG. 5*b* (for ~71 μm copolymer and ~150 μm glass particles) was similar to that in FIG. 6 (~71 μm copolymer and ~20 μm glass particles) as the dielectric constant of Silicone oil was closer to that of glass particles and so glass particles were weakly polarized and copolymer particles were strongly polarized. This shows that in addition to the particles' sizes, their polarizabilities, which can be modified by selecting suitable upper and lower fluids, are important in determining the structure of composite particles.

Figure 12:
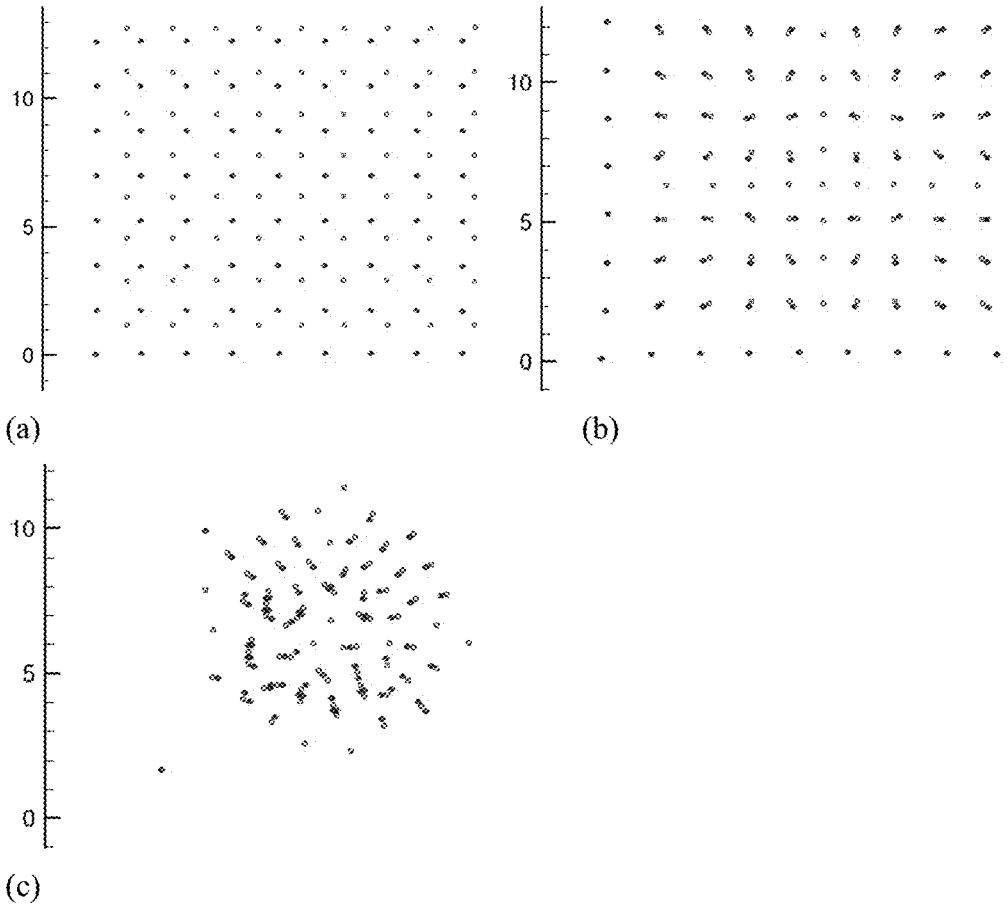
FIG. 12 shows numerical simulation of self-assembly of mixtures of particles on liquid surfaces. The parameters have been selected to match 71 μm copolymer (red) and 63 μm glass (yellow) particles on corn oil. The applied electric field was 500 kV/m. The ratio of the number of small to larger particles is 1:1. (a) Initial distribution, (b) intermediate distribution, and (c) final distribution. The two types of particles were placed on a periodic lattice. They rearranged to form doublets and then these doublets merged to form longer chains. These results are in agreement with our experimental results shown in FIG. 3.

The monolayer arrangement for a mixture of ~71 μm copolymer and ~63 μm glass particles was qualitatively different because of their comparable sizes. The repulsive force between glass particles was stronger than between copolymer particles, and the attractive force between glass and copolymer particles was moderately strong. The preferred arrangement for them was to form chains. Short particle chains formed immediately after the electric field was applied and then some of these chains merged to form longer chains. The simplest chains contained two particles, one glass particle and one copolymer particle (see FIG. 9). The next simplest chains contained a copolymer (or glass) particle in the middle and two glass (or copolymer) particles on the diagonally opposite sides. The repulsion between the glass (or copolymer) particles made three-particle chains approximately linear. Longer chains with 10-15 particles in which glass and copolymer particles alternated formed because of the merger of shorter chains. Some of the chains were not linear and contained branches. The orientation of chains varied. This result is similar to that for the orientation of ellipsoidal and rod-like particles in a monolayer which was also found to be random. The net dipole-dipole force among the chains was repulsive which kept them apart and thus stable while the electric field was kept on. These experimental results are in good agreement with our numerical simulation results shown in FIG. 12.

The structure of chains depended on the intensities of polarization of the particles which in turn depended on the dielectric properties of the upper and lower fluids. The average chain length was longer when both positively and negatively polarized particles were intensely polarized. For example, the average chain length on corn oil was shorter than on the oil mixture (see FIG. 10*a*) because the intensity of negative polarization of copolymer particles was weaker on the former. The dielectric constant of the oil mixture was larger which increased the dipole-dipole force between copolymer particles and increased the attractive force between a copolymer and a glass particle, making the attractive and repulsive forces more comparable and thus the formation of chains more likely.

Figure 13:
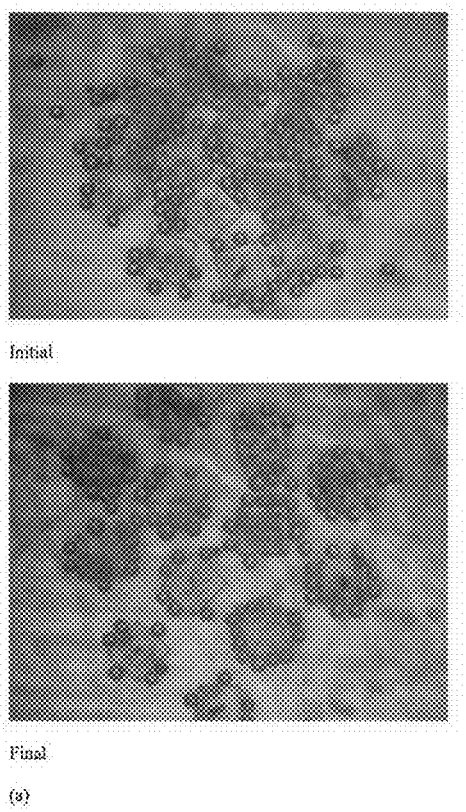
FIG. 13 shows monolayers of mixtures of cubical salt crystals and spherical particles on the surface of corn oil. (Left image) Before the electric field was applied. (Right image) After the electric field was applied, the dipole-dipole force caused salt crystals to move apart. (a) Spheres were 71 μm copolymer particles. The dipole-dipole force among salt crystals and copolymer particles was attractive and so the latter formed rings around the salt crystals. (b) Spheres were 63 μm glass particles. The dipole-dipole forces between glass particles were repulsive. Thus, glass particles moved away from salt crystals and also from each other, except those that were agglomerated.

In certain embodiments of the present invention the monolayer arrangements of the mixtures of cubical and spherical particles on the surface of corn oil were considered. The cubical particles were salt crystals with sides ~250 μm which were positively polarized. The spherical particles considered were 71 μm copolymer particles and 63 μm glass particles. FIG. 13*a* shows a monolayer of salt crystals and copolymer particles. Salt crystals clustered quickly under the action of lateral capillary forces before the electric field was applied because of their relatively larger size. After the field was applied, the dipole-dipole forces caused salt crystals to move apart (see FIG. 13*a*). The hierarchical arrangement in this case was qualitatively similar to that for a mixture of spherical particles described in FIG. 4. A composite particle consisted of a salt crystal at the center and several copolymer particles formed a ring around it. The repulsion among the copolymer particles of a ring was weaker compared to their attraction with the salt crystal, and so they touched each other.

The microstructure of a monolayer of salt crystals and glass particles, as FIG. 13*b* shows, was qualitatively different. Since salt crystals and glass particles were both positively polarized, the dipole-dipole forces among them were also repulsive. Thus, in this case, the force between all three particle pairs was repulsive. However, the repulsive force between glass particles was different from that between salt crystals because their sizes were different and also because their intensities of polarizations were different, and so the corresponding inter-particle distances were also different.

Thus, in multiple embodiments of the present invention it has been shown that it is possible to perform hierarchical self-assembly of mixtures of particles with different dielectric properties on fluid-liquid interfaces by applying an electric field in the direction normal to the interface. This is because the lateral dipole-dipole force between two particles is repulsive when both particles are positively or negatively polarized, but attractive when one particle is positively polarized and the other is negatively. The particles also experience an attractive capillary force that arises because of the net vertical forces acting on the particles which include their buoyant weights and vertical electric forces. The dipole-dipole force varies inversely with the fourth power of the inter-particle distance and the lateral capillary force varies inversely with the distance.

The differences in the polarizabilities and sizes of the particles allow one to vary the relative magnitudes of the inter-particle forces to derive a hierarchical self-assembly process that is analogous to the formation of molecules and their self-assembly in materials. Many different arrangements can be obtained by changing the fluids and particles properties. The technique is applicable to a broad range of particles of various shapes and is suitable for non-magnetic and uncharged particles since it manipulates particles based on their dielectric properties. It works for particles trapped in both liquid-liquid and air-liquid interfaces. When the electric field was turned off, the particles used in this study clustered, but clustered slowly and the speed with which they clustered decreased with decreasing particle size. The speed was negligibly small for 20 μm and smaller particles. This was however not the case in the presence of an electric field which induced stronger capillary and dipole-dipole forces. Also, although the self-assembled monolayers do not remain intact after the electric field is switched off, they can be frozen if one of the fluids is solidifiable in which case the monolayer is embedded on the surface of the solidified film.

The fluid-liquid interface based platform used here for self-assembling monolayers of mixtures of particles has two advantages. First, it allows variation of the inter-particle forces and thus the monolayer arrangement for a given mixture, by changing the fluids properties which can be done by selecting suitable upper and lower fluids, and also by changing the electric field intensity. Second, the technique exploits the fact that particles adsorbed in a fluid-liquid interface are free to move laterally, and therefore the equilibrium distance between two particles is independent of their initial positions in the interface. The latter is a consequence of the fact that the attractive force varies inversely with the inter-particle distance and the repulsive force varies inversely with the fourth power of the distance. On a solid substrate, on the other hand, particles cannot move freely because of the presence of frictional and adhesive forces.

Three distinct size dependent regimes were identified for the mixtures of glass and copolymer particles on corn oil. These regimes were also numerically simulated by keeping the particles and fluids properties fixed and only changing the sizes of the particles. When glass particles were about two times larger than copolymer particles, the former attracted copolymer particles to form composite particles. A composite particle consisted of a glass particle at the center which was surrounded by a ring of copolymer particles. The spacing between the composite particles increased with increasing electric field intensity, while the spacing between the copolymer particles of the rings remained unchanged. A second regime was obtained when the size of glass particles was about three times smaller. Although smaller in size, glass particles formed a triangular lattice in which copolymer particles were imbedded, as the former were more intensely polarized and repelled each other more strongly. Copolymer particles attracted nearby glass particles to form composite particles. In this regime the intra-composite particle forces were weaker than for the first regime. The particles forming the rings did not touch each other and interacted strongly with the lattice of glass particles. The latter is the reason why some of the glass particles escaped from the rings to occupy positions in the lattice when the field strength was increased above a critical value. A third regime was obtained when the size of glass and copolymer particles was comparable. Here instead of forming ring-like arrangements, particles arranged in chains in which the positively and negatively polarized particles alternated. In some instances, the chains contained sub-branches. This formation of chains is analogous to the formation of long chained polymeric molecules, except that the former were formed by particles in two dimensions on the surface of a liquid.

The technique allows one to modify the hierarchical structure of a monolayer of a given mixture, e.g., the structure of its composite particles and the distance between them, by changing the dielectric properties of the upper and lower fluids which determine the inter-particle forces. Thus, many more hierarchical arrangements could be obtained by varying the dielectric properties of the fluids, the particles sizes and properties, and having three or more types of particles. It is also noted that, for ~20-200 μm sized particles considered in this work, Brownian forces were negligible and so after their adsorption at the interface particles did not mix. Consequently, the structure of the assembled monolayers depended strongly on the initial distribution of particles. Therefore, for obtaining composite particles with uniform composition, the particles mixture must be uniformly mixed at particle scales. This may not be an issue for nano-particles for which Brownian forces can cause mixing.

METHODS

Figure 14:
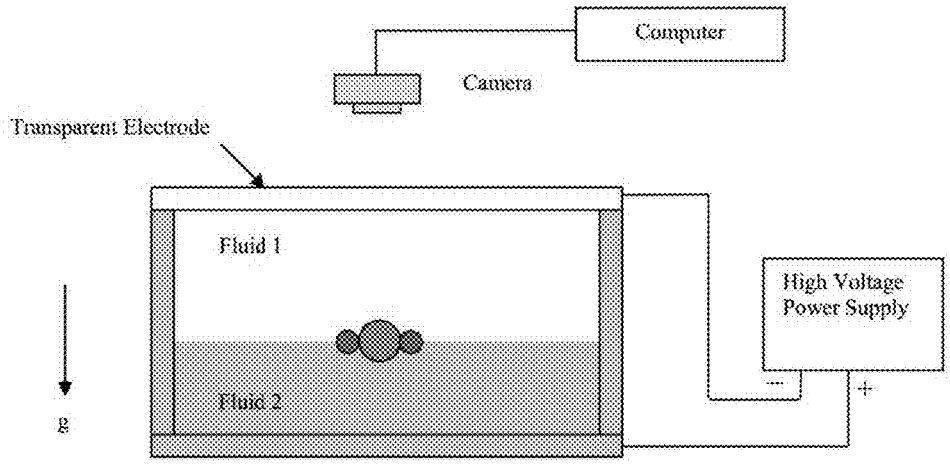
FIG. 14 shows a schematic diagram of the experimental setup.

A schematic diagram of the setup used to carry out the experiments involving certain embodiments of the present invention is shown in FIG. 14. The experimental setup is comprised of a circular chamber partially filled with a liquid or two liquids, one atop the other, forming a fluid-liquid interface. The top surface of the chamber was covered with a glass electrode coated with indium-tin-oxide (ITO). The coating made it electrically conducting while remaining transparent which allowed us to visualize the inside of chamber from the top. The bottom surface of the chamber had a copper electrode. A variable frequency ac signal generator (BK Precision Model 4010 A) was used along with a high voltage amplifier (Trek Model 610E) to apply a voltage to the electrodes at a frequency of 100 Hz. The maximum applied voltage was 10 kV, peak-to-peak. The diameter of the chamber was 52 mm and the height was 10 mm. A relatively large diameter of the device ensured that the electric field in the middle of the device where monolayers were formed was approximately uniform and in the direction normal to the liquid surface. The fluid-liquid interface was approximately at one half of the device height. Particles were sprinkled onto the surface of the liquid or placed in the liquids, through which they sedimented (or rose) to the liquid-liquid interface, and then the chamber was covered with the top electrode and the field was applied. The particle positions were recorded using a camera connected to a Nikon Eclipse ME600 microscope.

In examples of certain exemplary embodiments herein, 150, 63 and 20 μm diameter glass particles (MO-SCI Corporation), and 71 μm copolymer particles (Duke Scientific Corporation) were used. In addition to these spherical particles, salt crystals which were cubical with sides around 250 μm were used. The liquids used were corn oil (Mazola, ACH Food Companies), castor oil (Acros Organics) and Silicone oil (Dow Corning, FS1265). Additional experiments were carried out on a 30-70% mixture of corn and castor oils. The density and viscosity of corn oil were 0.922 g/cm$^3$ and 65.0 cP, of castor oil were 0.957 g/cm$^3$ and 985.0 cP, and of Silicone oil were 1.27 g/cm$^3$ and 381 cP. The dielectric constant of corn oil was 2.87 and the conductivity was 32.0 pSm$^{-1}$, for castor oil they were 4.7 and 32.0 pSm$^{-1}$, and for Silicone oil they were 6.7 and 370 pSm$^{-1}$. The dielectric constant of glass particles was 6.5 and the density was 2.5 g/cm$^3$. The dielectric constants of copolymer spheres and salt crystals were 2.5 and 5.8, respectively. The density of salt crystals and copolymer particles were 2.5 g/cm$^3$ and 1.05 g/cm$^3$, respectively.

Numerical Simulation of Self-Assembly of Mixture of Particles

Assume that there are n particles in a monolayer. The total lateral force on particle i due to the dipole-dipole interactions and the lateral capillary forces with the other particles can be obtained by a pair-wise addition of the interaction forces (16) which gives $$F_{li} = \sum_{j=1, j\neq i}^{n} F_{lij} = \sum_{j=1, j\neq i}^{n} \left( -\frac{w_i w_j}{2\pi\gamma} \frac{e_{ij}}{r_{ij}} + \frac{3 p_i p_j}{4\pi\varepsilon_0 \varepsilon_L} \frac{e_{ij}}{r_{ij}^4} \right) \tag{18}$$

Here $F_{lij}$ is the force on particle i due to particle j, $e_{ij}$ is the unit vector from the center of particle i to particle j, and $r_{ij}$ is the distance between the centers of particle i and particle j.

Furthermore, when a particle adsorbed in a fluid-liquid interface moves because of these inter-particle forces it experiences a drag force. Since the particle velocity during the self-assembly process remains small, we can use the Stokes equation to estimate the drag $$F_{di}=-6\pi\mu\xi\alpha_i u_i, \tag{19}$$

where $\mu$ is the viscosity of the lower fluid, $u_i$ is the velocity, and $\xi$ is a parameter which accounts for the fact that the particle is immersed in both upper and lower fluids. The drag force becomes zero after the particles of the monolayer reach their equilibrium positions and stop moving.

The momentum equation of particle i can be obtained by setting the force equal to the sum of (18) and (19)

$$m_i\frac{du_i}{dt}=\sum_{j=1,j\neq i}^{n}\left(-\frac{w_i w_j}{2\pi\gamma}\frac{e_{ij}}{r_{ij}}+\frac{3p_i p_j}{4\pi\varepsilon_o\varepsilon_L}\frac{e_{ij}}{r_{ij}^4}\right)-6\pi\mu\xi a_i u_i, \tag{20}$$

where $m_i$ is the effective mass of the $i^{th}$ particle which includes the added mass contribution. The above system of equations for n particles was discretized using a second order scheme in time. A hard sphere potential was used to avoid overlapping of the particles.

The results of the simulations in which the parameters have been selected to match the values in the experiments were obtained. The self-assembly process was simulated by placing n particles on a regular grid, and then these positions were moved randomly such that the particles did not overlap. The equations were integrated in time until a stable monolayer arrangement was obtained.

For particle mixtures adsorbed on the corn oil surface, the fluid and particle properties appearing in equations (16) and (19) were: $\varepsilon_\alpha=1.0$, $\varepsilon_L=2.87$; the dielectric constants of glass and copolymer particles were 6.5 and 2.5, respectively; and the density of glass and copolymer particles were 2.5 and 1.05, respectively. The corn oil viscosity was assumed to be 65 cP. Based on these values, the theoretical estimates of the Clausius-Mossotti (CM) factors of the particles were $\beta_1=0.297$ and $\beta_2=-0.045$. Here the subscripts "1" and "2" refer to glass and copolymer particles. The values of the remaining parameters in equations (16) and (19) were estimated to be $fv_1=0.1$, $fv_2 32\ 0.1$, $fb_1=1.5$, $fb_2=0.05$ and $\xi=0.5$. The particle sizes were assumed to be equal to the value in our experiments and the electric field strength $E_0$ was obtained in terms of the applied voltage (V) and the gap between the electrodes (L). Using these parameter values, the values of $p_1$, $p_2$, $w_1$ and $w_2$ in equation (20) were obtained using equation (5) and (13).

The number of particles in the simulations was held fixed at 144, but the ratio of the number of positively to negatively polarized particles was varied. For the results presented in FIG. 11, 12, 15, all of the parameter values were held fixed and only the particle sizes were varied. The lengths have been nondimensionalized such that the size of larger particles is 0.1. The diameter of circles used to represent particles is proportional to the size of the particles.

Figure 15:
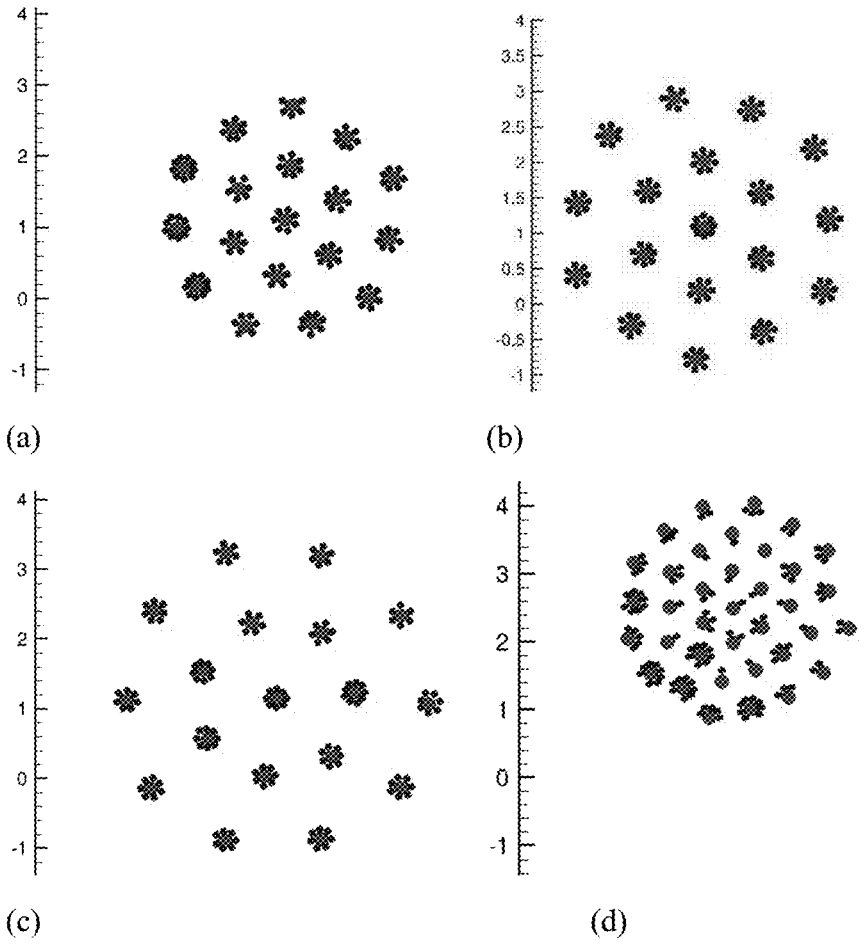
FIG. 15 shows numerical simulation of self-assembly of mixtures of particles on liquid surfaces. The parameters were selected to match 71 μm copolymer and 150 μm glass particles on corn oil. The applied electric field was 560 kV/m in (a), 700 kV/m in (b), 840 kV/m in (c), and 500 kV/m in (d). The ratio of the number of small to larger particles was 7:1 in (a)-(c) and 3:1 in (d). The scale is for reference to show how the monolayer expands or shrinks with the electric field intensity. Notice that the distance between the composite particles increased with increasing electric field intensity, but the number of particles in the rings of composite particles remained constant. In (d) the electric field strength was the same as in FIG. 1*d*, but the ratio of the number of small to larger particles was 3:1 and a larger fraction of particles were initially near the left and bottom sides. Notice that since there were not enough small particles and that their concentration was initially larger near the left and bottom sides, the particle rings in this region contain more particles.

The three distinct size dependent regimes identified in embodiments of the present invention for the mixtures of glass and copolymer particles on corn oil were also found in the numerical simulations. The summary of results for certain embodiments of the present invention is as follows:

In FIG. 15, the larger sized particles were positively polarized (the same properties as of the glass particles in the experiments) and the smaller particles were negatively polarized (the same properties as of the copolymer particles in our experiments). The larger sized particles attracted the smaller ones to form composite particles similar to those seen in the experiments (see FIG. 4). Also, as in other embodiments of the present invention, the spacing between the composite particles increased with increasing electric field intensity, while the spacing between the copolymer particles of the rings remained unchanged. The average distance between the composite particles of the lattice in FIG. 4*d* was approximately 12% larger than the experimental value in FIG. 4*b* for the same electric field intensity. This agreement is good considering the fact that approximations were made in obtaining equation (1) and that equation (18) is obtained by performing a pair-wise addition of the particle-particle forces. In FIG. 15*d*, the case was considered where the ratio of the number of small to larger particles is 3:1 and so there were not enough smaller particles needed to form complete rings around all of the larger particles. Also, a higher concentration of smaller particles was placed near the left and bottom sides. Notice that the composite particles in this case contain fewer particles and the number of particles in the rings of composite particles farther away from the left and bottom sides is smaller. This shows that for obtaining composite particles with uniform composition the mixture should be uniformly mixed.

FIG. 16 shows a case in which the smaller sized particles were more intensely polarized. This case corresponds to FIG. 6 where glass particles were about three times smaller than less intensely polarized copolymer particles. As seen in previous embodiments, the smaller particles formed a triangular lattice in which the larger particles were imbedded. The larger particles attracted nearby smaller particles in the lattice and together they formed composite particles. The number of smaller particles in the composite particles varied between 3 and 5 depending on the electric field intensity, which also agrees with the experimental results. The electric field intensity was also varied to investigate the strength of intra-particle forces. When the electric field strength was increased to 700 kV/m a smaller sized particle escaped from the rings reducing the number of particles to 4. The escaped particles were absorbed in the lattice which expanded to accommodate them. In this regime the intra-composite particle forces were weaker than in the first regime and the particles forming the rings did not touch each other.

FIG. 17 shows a third regime for which the size of positively and negatively polarized particles was comparable. In this case, instead of forming ring-like arrangements particles arranged in chains in which the positively and negatively polarized particles alternated. Initially, particles formed doublets of positively and negatively particle, and then these doublets merged to form longer chains. These simulation results are similar to those shown in FIG. 9 for a mixture of glass and polymer particles. Notice that particles came together with time to the equilibrium spacing. The exact distribution depended on the initial distribution of particles. This shows that when the positively and negatively polarized particles are of the comparable sizes they self-assemble to form particle chains.

It is noteworthy that the particle and fluid properties for the above three numerically assembled monolayers were the same and only the particle sizes and the electric field intensities were varied. This was also the case for the other exemplary embodiments. This shows that the theoretical model given by equations (1) and (20) correctly captures the underlying physics.

Although the systems and methods of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

The invention claimed is:

1. A method for producing a film which comprises:

providing a first plurality of first particles, each of the first particle having a first particle size;

providing a second plurality of second particles, each of the second particle having a second particle size;

providing the first and second pluralities of first and second articles in a fluid-fluid interface, wherein dipole-dipole forces between the first and second particles are attractive or repulsive, and wherein capillary forces between the first and second particles are attractive, applying an ac or dc electric field in a direction normal to the fluid-fluid interface to form a monolayer of the first and second particles through (i) lateral movement of the first and second particles in the fluid-fluid interface and, (ii) hierarchical self-assembly of the first and second particles based on the dipole-dipole forces and capillary forces exerted therebetween;

wherein when the first article size differs from the second article size by a factor of two or more and the second particle size is larger than the first particle size, some of the first particles form a ring around one of the second particle after applying the ac or dc electric field in the direction normal to the fluid-fluid interface to form the monolayer.

2. The method of claim 1, wherein after formation of the ring, increasing the electric field above an upper intensity range decreases the number of the first particles from the ring.

3. The method of claim 1, wherein the second particles are selected to attach to the first particles so that the first particles can be removed from the interface.

4. The method of claim 1, wherein the electric field induces dipole-dipole forces between the first and second particles that are attractive.

5. The method of claim 4, wherein the electric field induces dipole-dipole forces between the first and second particles that are repulsive.

6. The method of claim 4, wherein the electric field induces capillary forces between the first and second particles that are attractive.

7. The method of claim 1, wherein the inter-particle distance of the monolayer is varied dynamically by changing the electric field intensity.

8. The method of claim 1, wherein the hierarchical self-assembly of the monolayer is varied dynamically by changing the electric field intensity.

9. The method of claim 1, wherein the first and second particles are dielectric or metals.

10. The method of claim 4, wherein the first and second particles contain different polarizabilities which come together when the electric field is applied.

11. The method of claim 1, further comprising embedding the monolayer of the first and second particles on a surface of the film.

12. The monolayer of the first and second particles with the hierarchical self-assembly of the first and second particles formed according to the method of claim 1.

13. A method for producing a film which comprises:

providing a first plurality of first particles, each of the first particle having a first particle size;

providing a second plurality of second particles, each of the second particle having a second particle size;

providing the first and second pluralities of first and second particles in a fluid-fluid interface, wherein dipole-dipole forces between the first and second particles are attractive or repulsive, and wherein capillary forces between the first and second particles are attractive, applying an ac or dc electric field in a direction normal to the fluid-fluid interface to form a monolayer of the first and second particles through (i) lateral movement of the first and second articles in the fluid-fluid interface and, (ii) hierarchical self-assembly of the first and second particles based on the dipole-dipole forces and capillary forces exerted therebetween;

wherein when the first particle size is comparable to the second particle size and when the polarizability of the first plurality of first particles is comparable to the polarizability of the second plurality of wecond particles, some of the first and second particles form tightly packed crystals with one another after applying the ac or dc electric field in the direction normal to the fluid-fluid interface to form the monolayer.

* * * * *